US005577672A

United States Patent [19]

Holmes

[11] Patent Number: 5,577,672

[45] Date of Patent: Nov. 26, 1996

[54] METHOD AND APPARATUS FOR DISINTEGRATING WALLBOARD

[75] Inventor: William G. Holmes, LaGrange, Ill.

[73] Assignee: Continental Tire Recyclers, L.L.C., Geneva, Ill.

[21] Appl. No.: 390,993

[22] Filed: Feb. 21, 1995

[51] Int. Cl.[6] ..... B02C 19/00; B02C 19/12

[52] U.S. Cl. ..... 241/14; 241/29; 241/152.2; 241/186.35; 241/271; 241/DIG. 38

[58] Field of Search ..... 241/14, 29, 152.2, 241/186.35, 271, DIG. 38

[56] References Cited

U.S. PATENT DOCUMENTS

| | | | |
|---|---|---|---|
| 1,910,382 | 5/1933 | Doyle | 241/186.35 X |
| 3,845,907 | 11/1974 | Schwarz . | |
| 3,880,361 | 4/1975 | Schwarz . | |
| 3,946,662 | 3/1976 | Ross, Jr. et al. . | |
| 3,981,455 | 9/1976 | Kaczmarek . | |
| 4,146,183 | 3/1979 | Nikkel | 241/30 |
| 4,148,952 | 4/1979 | Nelson et al. | 428/2 |
| 4,247,056 | 1/1981 | Kaczmarek . | |
| 4,609,155 | 9/1986 | Garnier . | |
| 4,796,821 | 1/1989 | Pao et al. | 241/101.2 |
| 4,801,101 | 1/1989 | Dreyer et al. | 241/240 |
| 4,844,363 | 7/1989 | Garnier et al. . | |
| 5,205,495 | 4/1993 | Garnier . | |
| 5,405,093 | 4/1995 | Bozarth | 241/34 |

*Primary Examiner*—John M. Husar
*Attorney, Agent, or Firm*—Leydig, Voit & Mayer, Ltd.

[57] ABSTRACT

Sheets of defectively manufactured wallboard are loaded in a stack on a conveyor and are advanced intermittently to a shearing station where a shear periodically cuts through the stack to sever successive leading end sections from the stack. Each cut-off leading end section drops into a shredder which reduces the wallboard into small particles and chunks capable of being recycled.

24 Claims, 7 Drawing Sheets

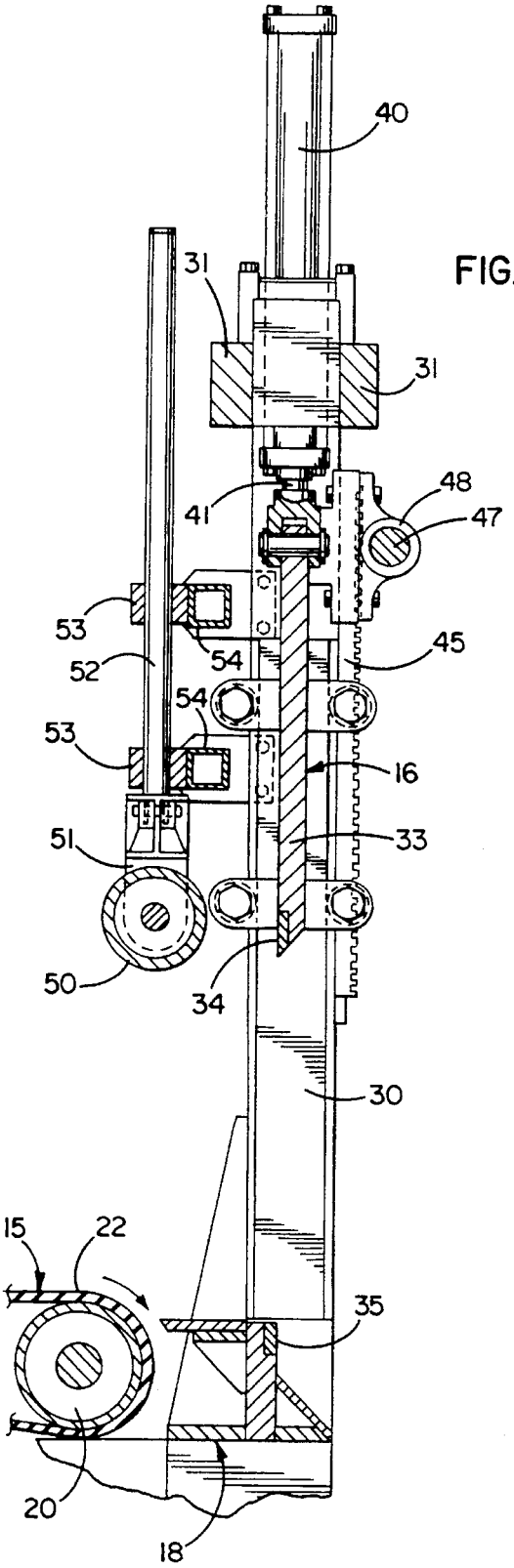
FIG. 8
FIG. 9
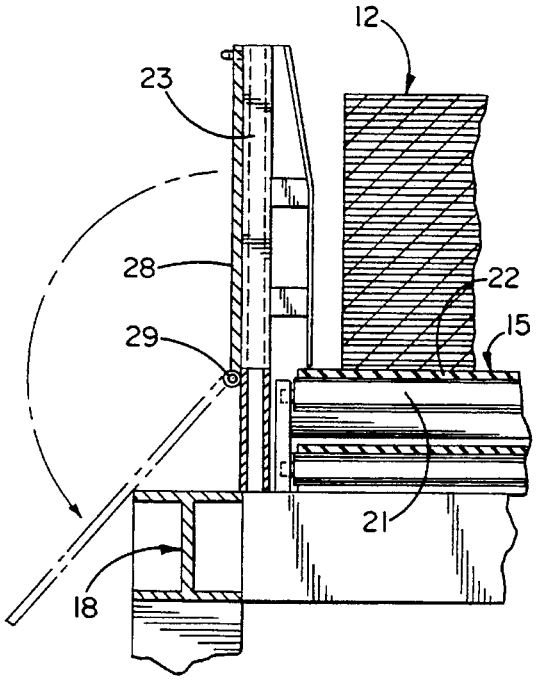

METHOD AND APPARATUS FOR DISINTEGRATING WALLBOARD

BACKGROUND OF THE INVENTION

This invention relates to apparatus for disintegrating sheets of shreddable material and, more particularly for disintegrating sheets of wallboard.

Typically, wallboard is formed by a layer of gypsum sandwiched between layers of paper, paperboard or the like. A relatively small percentage of wallboard is defective when manufactured and must be disposed of by the manufacturer. In the past, defective wallboard has simply been dumped in landfills. Environmental concerns, however, have placed increased restrictions on the landfilling of wallboard. In addition, the defective wallboard contains materials which, if properly processed, are capable of being recycled and used in other building materials. Accordingly, many wallboard manufacturers have been breaking up defective wallboard in order to enable recycling thereof.

A rather primitive but widely used method of breaking up wallboard is to pile the wallboard on a floor and to run back and forth over the wallboard with a truck. This has several disadvantages in that it is slow and labor intensive, produces very disuniform break up of the material, is dirty and requires the broken up material to be scooped up for delivery to a further processing station.

A more recent method involves feeding the sheets of wallboard endwise into a grinding roller which is rotated at high speeds. This process also is dirty and, because a high speed grinding roll is required, chunks of wallboard fly out of the grinder in the form of high speed projectiles. This creates a dangerous operating environment and requires retrieval of the chunks which fly from the grinder. The process also is very noisy.

SUMMARY OF THE INVENTION

The general aim of the present invention is to provide new and improved method and apparatus by which wallboard or other sheet material is automatically disintegrated in a relatively high speed but controlled manner, in a comparatively safe, clean and quiet working environment and in a fashion facilitating further processing of the material.

A more detailed object of the invention is to achieve the foregoing by automatically shearing stacks of wallboard into relatively short sections capable of being handled by a relatively small shredder and by supplying the cut-off sections to the shredder for disintegration into small particles or chunks.

Still another object of the invention is to provide disintegrating apparatus into which stacks of defective wallboard may be easily loaded through the use of a forklift truck.

The invention also resides in the rugged and durable construction of the apparatus for shearing the wallboard.

These and other objects and advantages of the invention will become more apparent from the following detailed description when taken in conjunction with the accompanying drawings.

BRIEF DESCRIPTION OF THE DRAWINGS

FIG. 8 is an enlarged fragmentary cross-section taken substantially along the line 8—8 of FIG. 6.

FIG. 9 is an enlarged fragmentary cross-section taken substantially along the line 9—9 of FIG. 2.

Figure 1:
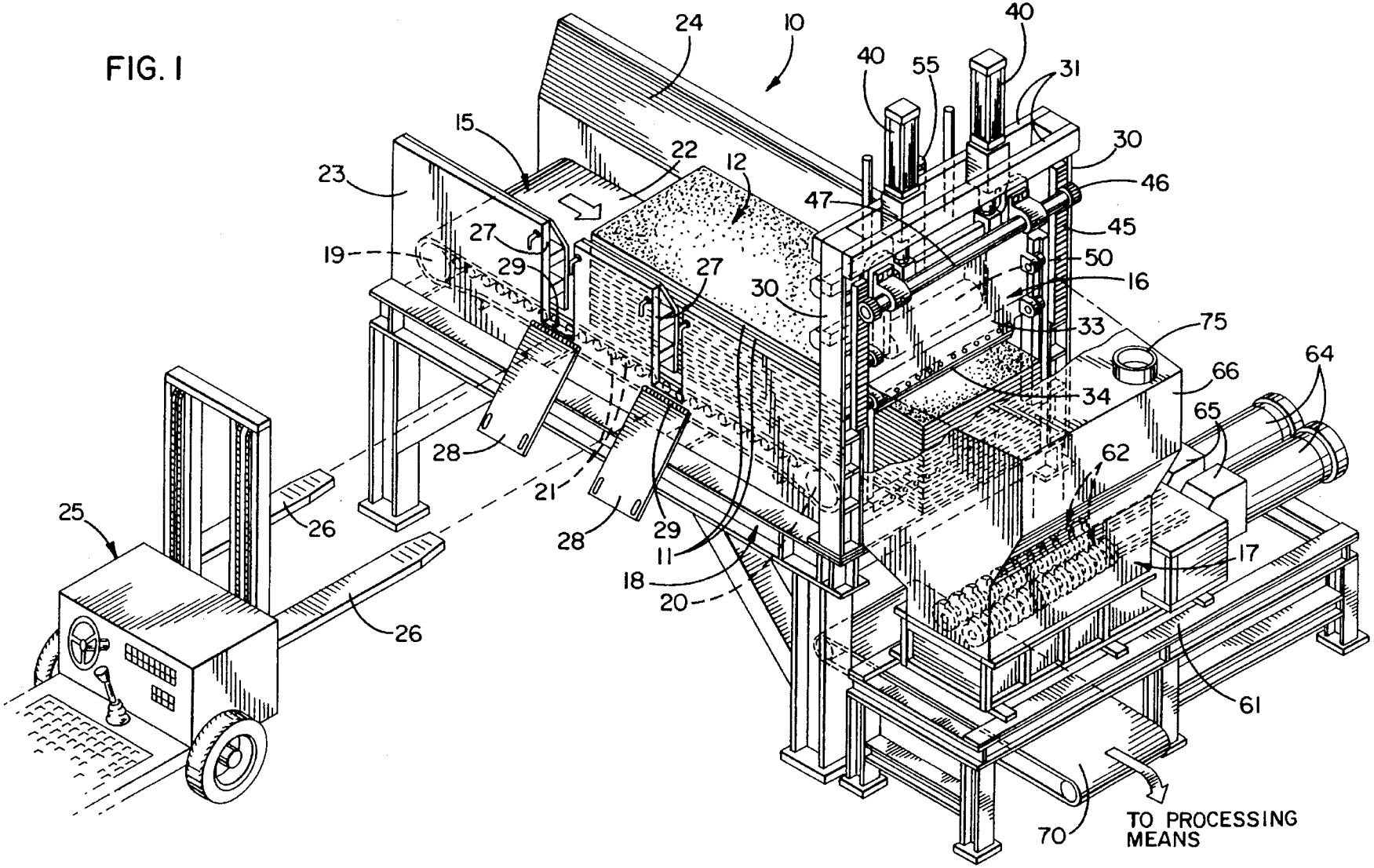
FIG. 1 is a perspective view of new and improved wallboard disintegrating apparatus incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the invention has been shown in the drawings as incorporated in apparatus 10 for disintegrating sheet material such as defectively manufactured wallboard 11 into small chunks and particles in order to enable recycling of the material. The wallboard which has been shown is formed by a layer of gypsum sandwiched between layers of heavy paper. Each sheet 11 of wallboard typically is 4'×8'.

The present invention contemplates the provision of method and apparatus for automatically disintegrating a stack 12 of wallboard 11 through sequential shearing and shredding operations. The invention enables relatively easy and rapid handling of the wallboard, maintains a comparatively clean, safe and quiet work environment, and disintegrates the wallboard in a manner facilitating economical recycling or further processing of the material from which the wallboard is formed.

In general, the invention is carried out by loading a stack 12 of defective sheets 11 of wallboard onto a conveyor 15 which is adapted to advance the stack endwise and step-by-step along a generally horizontal path. Each time the stack is advanced, its leading end section moves past a shear 16 and dwells in a shearing station. When the stack dwells, the shear is operated and acts to cut the leading end section away from the stack. The cut-off leading end section may, for example, be in the form of a strip having a dimension of 12'in the direction of advance of the conveyor 15. The cut-off strip is delivered to a shredder 17, preferably by dropping into the shredder, and is reduced to particles and chunks having an area not significantly greater than two square inches. After the wallboard has been disintegrated by the shredder, the particles and chunks are conveyed away from the shredder to a further processing station where the material is subjected to recycling operations.

More specifically, the apparatus 10 includes a main frame which has been designated in its entirety by the reference numeral 18 and which supports the conveyor 15 and the shear 16. The conveyor includes upstream and downstream main rollers 19 and 20 and a series of smaller diameter rollers 21 disposed between the main rollers and located with their upper surfaces in the same horizontal plane as the upper surfaces of the main rollers. An endless belt 22 is trained around the main rollers and its upper run is supported in a horizontal plane by the rollers. The downstream main roller 20 is intermittently driven by a servomotor (not shown) to advance the belt through a selected distance (e.g., 12"). The belt dwells between successive steps to enable the shear 16 to cut off successive leading end sections of the stack 12.

Two laterally spaced side walls 23 and 24 project upwardly from the frame 18 and define guide walls which extend along and above the conveyor 15. The walls 23 and 24 confine the stack 12 on the conveyor as the stack is advanced toward the shear 16.

Pursuant to the invention, a stack 12 of wallboard 11 is adapted to be quickly and easily loaded onto the conveyor 15 by a forklift truck 25 having a pair of lifting forks 26 capable of sliding beneath the stack, transporting the stack to the conveyor, raising the stack to level above the side wall 23, shifting the stack into overlying relation with the conveyor belt 22 and then lowering the stack onto the belt. To accommodate the forks 26, the side wall 23 is formed with a pair of vertically extending slots 27 which open upwardly out of the side wall, the slots being spaced along the side wall in accordance with the spacing between the forks. By virtue thereof, the forks may move downwardly into the slots 27 and toward the belt 22 after the stack 12 has been raised above the side wall 23 and positioned in overlying relation with the belt. When the forks are just a short distance away from the belt, the forks are retracted out of the slots, and the stack is allowed to drop onto the belt. The side wall 23 confines the stack laterally to permit retraction of the forks from beneath the stack.

Figure 2:
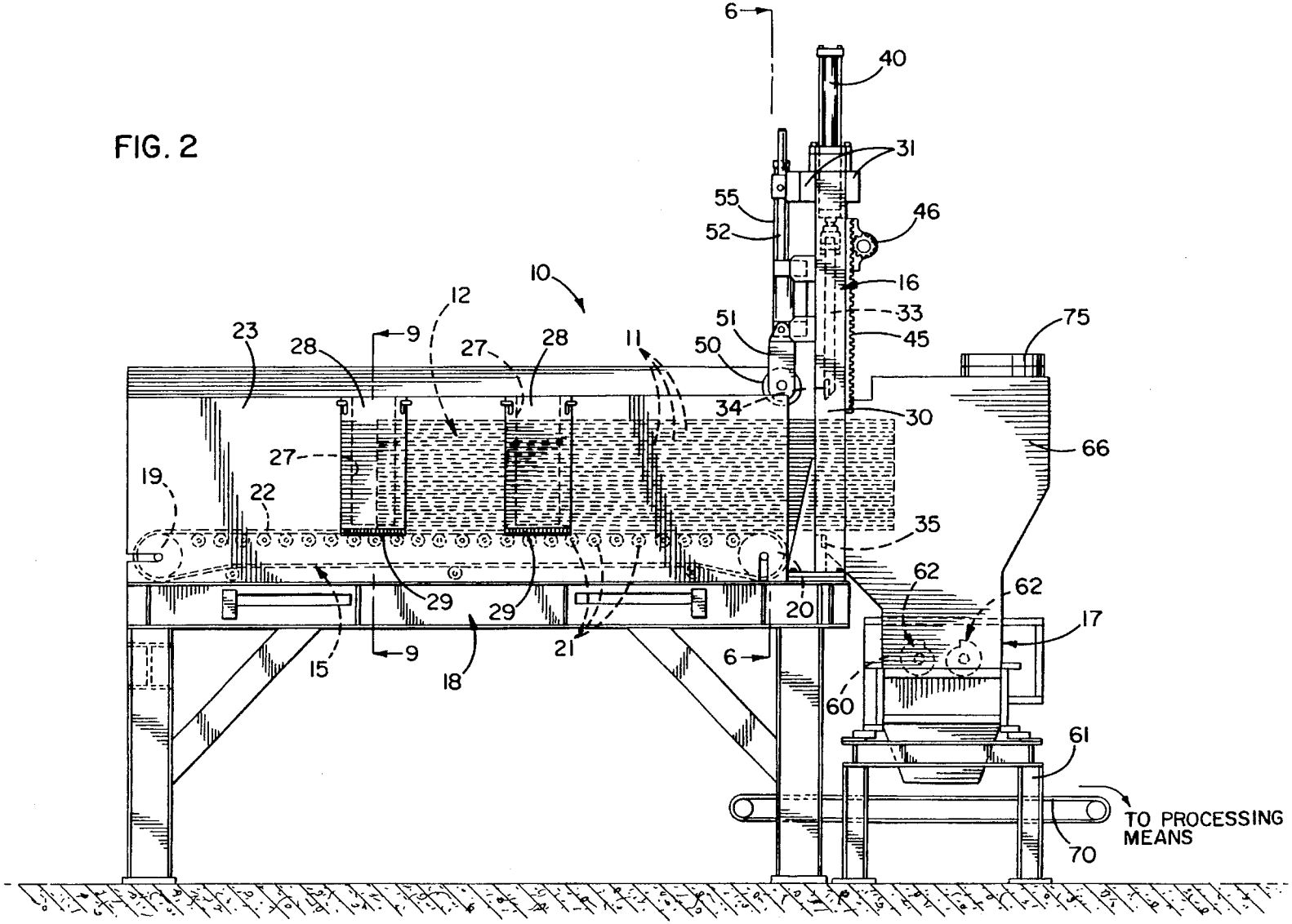
FIG. 2 is a side elevational view of the disintegrating apparatus shown in FIG. 1.

In some instances, the apparatus 10 may be used to disintegrate small scraps of waste wallboard created during the wallboard manufacturing operation. In such a case, the scrap material is dumped onto the conveyor 15 by an end loader (not shown) and is simply advanced directly by the conveyor to the shredder 17 for purposes of reducing the scrap into smaller particles and chunks. To close the slots 27 and confine the scrap on the conveyor, doors 28 are hinged at their lower edges to the side wall 23 as indicated at 29 and are adapted to be moved between open positions (FIG. 1) and closed positions (FIGS. 2 and 9). The doors are adapted to be held releasably in their closed positions by manually operable latches located on the side wall 23 near the upper end portions of the doors. As long as the apparatus 10 is running sheets 11, the doors 28 may be left open if desired.

Figure 3:
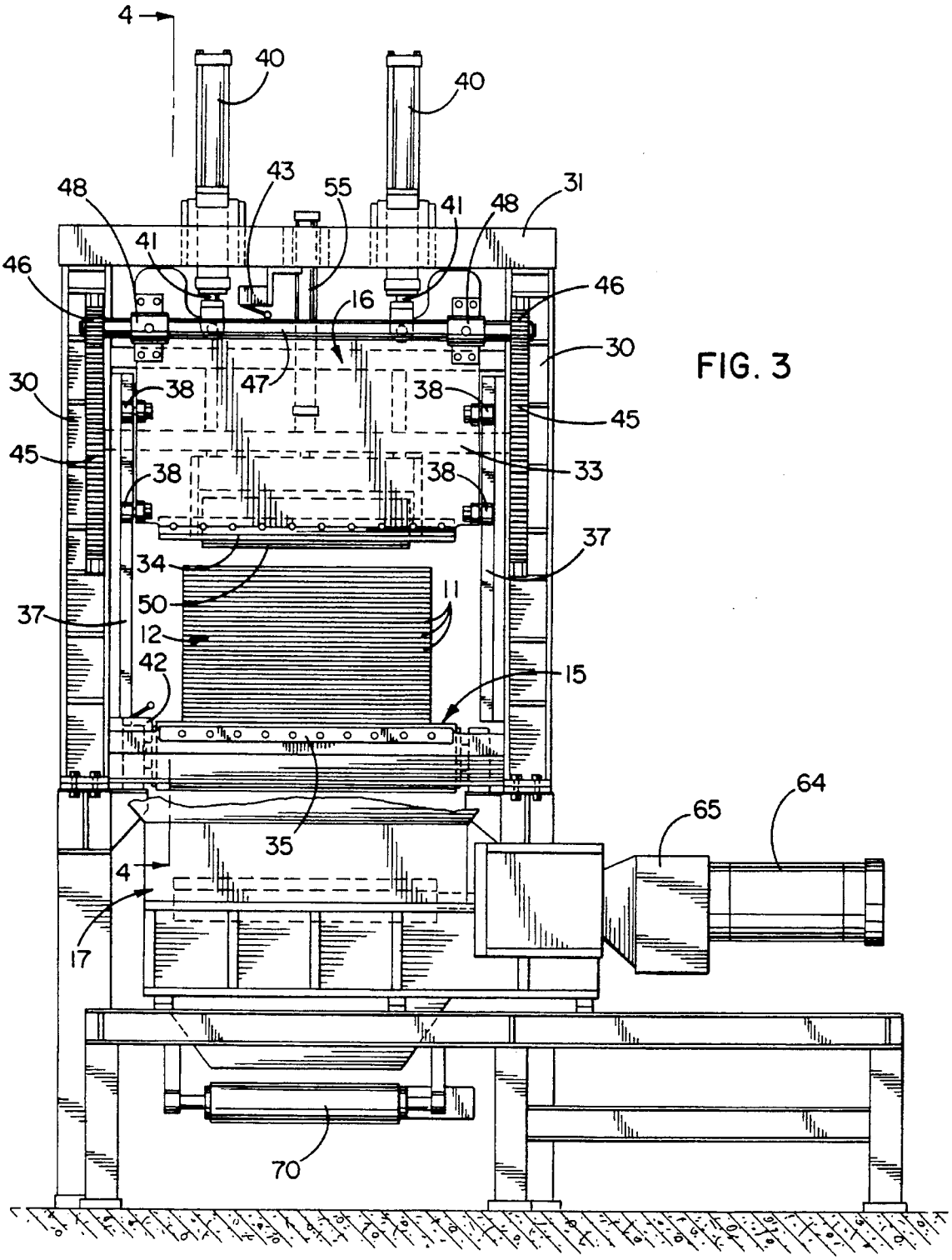
FIG. 3 is an end view as seen from the downstream end of the apparatus, certain components being broken away for purposes of clarity.
Figure 4:
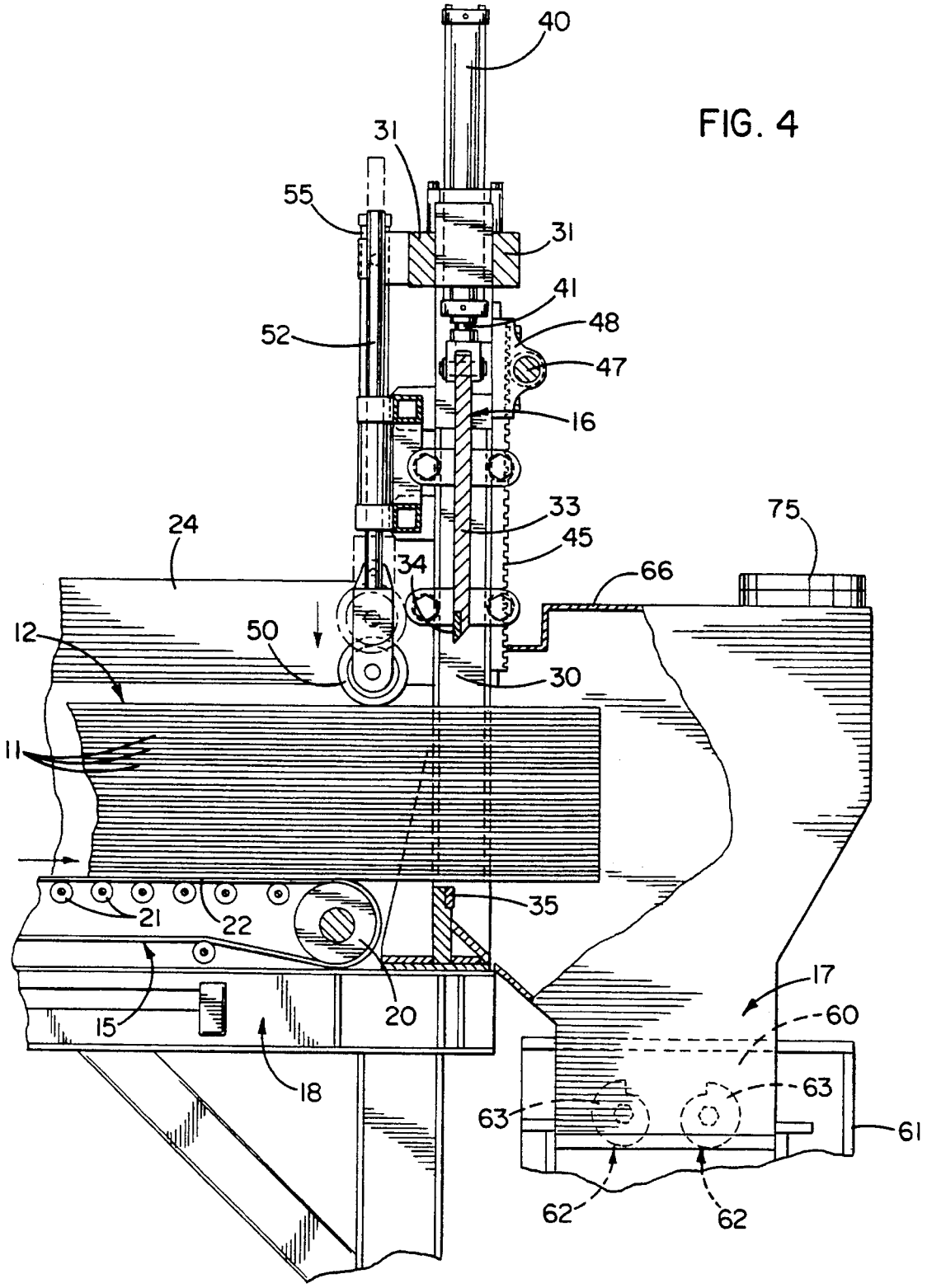
FIG. 4 is a fragmentary cross-section taken substantially along the line 4—4 of FIG. 3.
Figure 5:
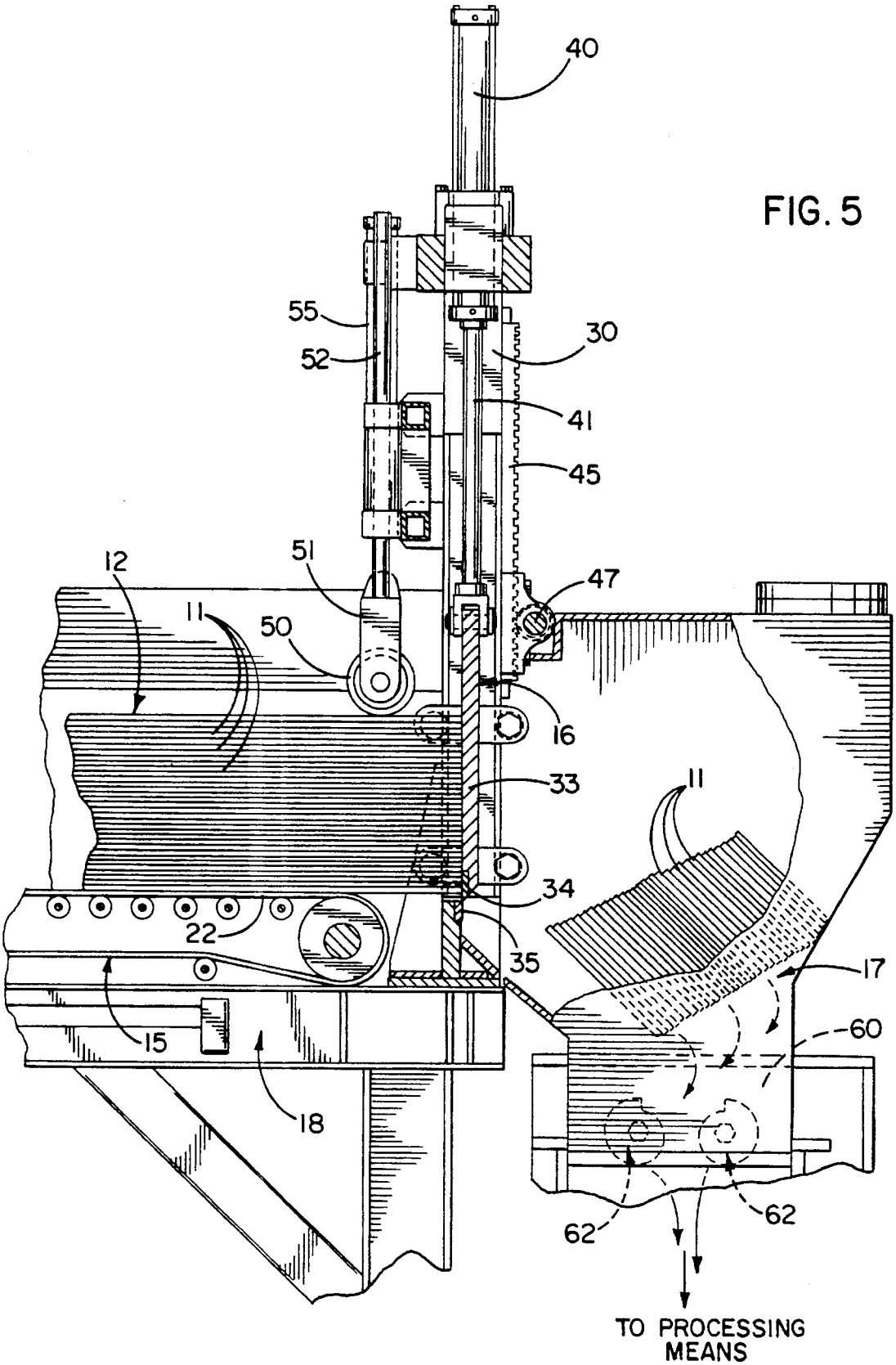
FIG. 5 is a view similar to FIG. 4 but shows certain components of the apparatus in moved positions.
Figure 6:
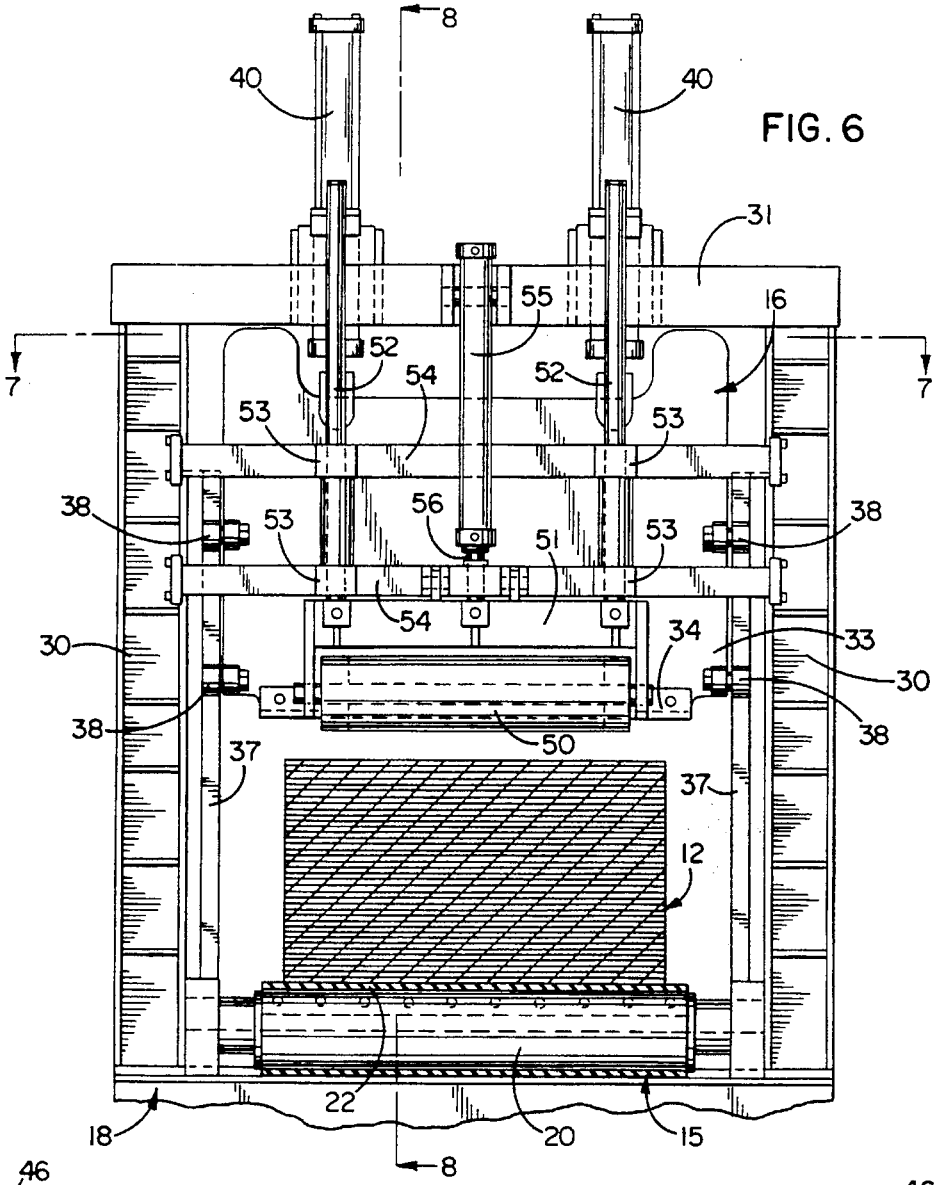
FIG. 6 is an enlarged fragmentary cross-section taken substantially along the line 6—6 of FIG. 2.

The shear 16 includes two vertically extending and laterally spaced columns 30 whose upper ends are spanned by laterally extending bars 31. As shown in FIGS. 3 and 4, the shear further includes a vertically extending blade holder 33 having a shear blade 34 on its lower end (see FIG. 8). The blade holder is adapted to be reciprocated upwardly and downwardly between a retracted position (FIGS. 1, 2, 3, 4, 6 and 8) in which the blade is spaced upwardly from the stack 12 and a cutting position (FIG. 5) in which the blade shears downwardly through the stack to a location beneath the stack. A fixed blade 35 (FIGS. 5 and 8) is secured to the frame 18 just beneath the stack and coacts with the blade 34 as the latter completes its downward stroke through the stack.

Figure 7:
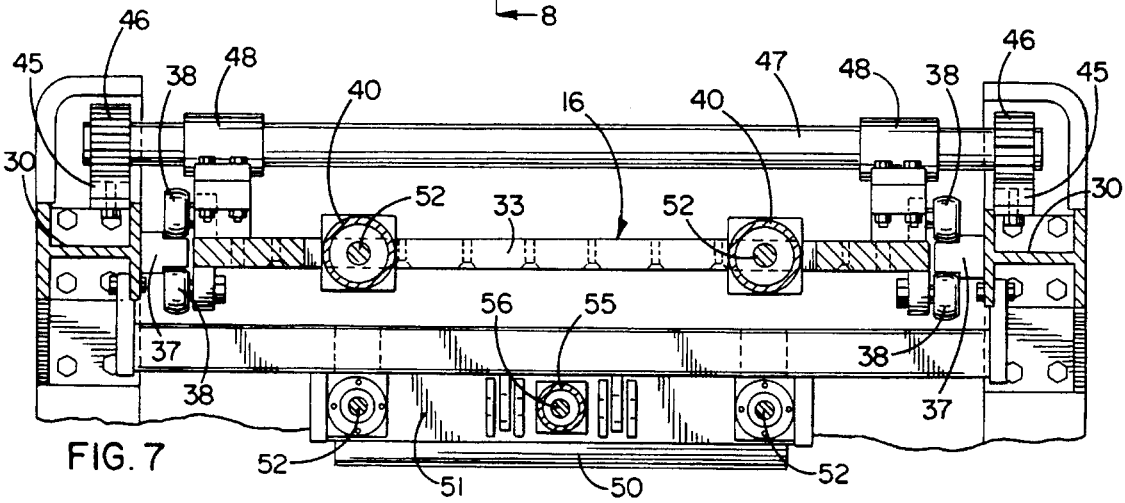
FIG. 7 is a fragmentary cross-section taken substantially along the line 7—7 of FIG. 6.

To guide the blade holder 33 for up and down movement, vertical rails 37 (FIGS. 6 and 7) are secured to the inboard sides of the columns 30. Upper and lower vertically spaced pairs of rollers 38 are attached to the outboard edge portions of the holder and are located such that the rollers of each pair ride along opposite sides of the adjacent track.

Up and down movement of the holder 33 and the blade 34 is effected by a pair of laterally spaced hydraulic actuators 40 supported by the bars 31 and having elongated rods 41 (FIG. 5) connected to the upper end of the holder. Downward advancement of the rods forces the blade 34 downwardly through the stack 12 until the lower end of the holder engages and closes a limit switch 42 (FIG. 3) on one of the columns 30. The actuators then are reversed to cause the rods to retract the holder upwardly preparatory to the next cutting stroke. An additional limit switch 43 is adapted to be engaged and closed by the upper end of the holder to terminate the upward stroke of the rods.

Considerable force is required to move the blade 34 downwardly through the stack 12 and particularly if the stack contains a large number of sheets 11 of wallboard. In order to provide rigidity to the blade and the holder 33 during the cutting stroke, vertically extending toothed racks 45 (FIGS. 3 and 7) are fixed to the downstream sides of the columns 30 and coact with pinions 46 carried by the holder. The pinions are secured to the ends of a laterally extending shaft 47 which is rotatably supported by laterally spaced bearings 48 attached to the upper end portion of the holder. The pinions acting against the rack coact with the tracks 37 and the rollers 38 to keep the holder in a rigid and straight condition as the blade 34 shears through the stack 12.

To hold the stack 12 stable during the shearing operation, means herein in the form of a roller 50 apply downward pressure to the stack immediately upstream of the shear blade 34. The roller extends laterally of the stack and its ends are journaled in a yoke 51. Upwardly extending rods 52 (FIGS. 6 and 8) are attached to the yoke and are slidably guided by vertically spaced pairs of laterally spaced bushings 53 supported by vertically spaced and laterally extending bars 54 which, in turn, are attached to the upstream sides of the columns 30. The roller 50 is adapted to be shifted upwardly and downwardly by a reciprocating hydraulic actuator 55 (FIG. 6) having a rod 56 located between the rods 52 and connected to the yoke 51. As will be explained in more detail subsequently, the rod 56 advances downwardly until the roller 50 engages the top of the stack 12 and causes pressure to build up in the actuator 55 to produce a signal for effecting operation of the actuators 40 to advance the shear blade 34 downwardly.

The shredder 17 is located downstream of and below the downstream end of the conveyor 15 and includes a shredding chamber 60 (FIG. 4) which is supported on a stand 61. Two hex shafts 62 each having a plurality of axially spaced shredding knives 63 are located in the chamber 60 and are adapted to be rotated in opposite directions by motors 64 (FIG. 1) acting through speed reducers 65. A closed hopper 66 (FIG. 4) is located above the shredding chamber 60 and receives the cut-off end section of the stack 12, the hopper being shaped to funnel the cut-off end section into the cutting chamber. When the cut-off wallboard encounters the shredding knives 63, it is chopped up into particles ranging in size from dust to chunks having an area of approximately two square inches. The disintegrated wallboard drops out of the shredding chamber 60 and onto an exit conveyor 70 (shown schematically in FIGS. 1 and 2) which carries the material to further processing operations.

The hopper 66 encloses the area immediately downstream of the shear 16 and receives most of the dust produced by the shearing operation. A dust collector (not shown) may be connected to the hopper at 75 in order to remove fine dust resulting from the shearing and shredding operation.

To summarize operation of the apparatus 10, the forklift truck 25 picks up a stack 12 of wallboard 11 and delivers the stack to the apparatus. In many wallboard manufacturing plants, wallboard is piled in stacks when it is first determined that the wallboard is defective and thus the ability of the apparatus 10 to handle stacks avoids the need of rearranging the material for purposes of being disintegrated by the apparatus. The stacks may range between 6" and 48" in height and the individual wallboards in the stack may range from ⅜" to 1" in thickness.

By virtue of the slots 27 in the side wall 23 of the conveyor 15, the forks 26 of the truck 25 may raise the stack 12 above the side walls 23 and 24 and then lower the stack onto the conveyor belt 22. The conveyor may be set to advance the stack through any distance ranging between 6" and 24" the length of the advance being determined by the height of the stack and by the thickness of the individual wallboards in the stack. Upon being advanced, the conveyor feeds the stack downstream until a strip of desired dimension moves past the shear blades 34 and 35 and into overhanging relation with the shredding chamber 60.

When the conveyor belt 22 dwells, the actuator 55 is pressurized to advance the pressure roller 50 downwardly into engagement with the top of the stack 12 for purposes of holding the stack stable during the shearing operation. When the pressure in the actuator 55 reaches a predetermined magnitude, the actuators 40 are pressurized to advance the blade 34 downwardly through the stack and cut off the leading end section thereof. That section falls into the shredding chamber 60 and, after being disintegrated by the knives 63, is carried away by the exit conveyor 70.

As soon as the shear blade 34 completes its stroke, the holder 33 closes the limit switch 42 to cause the actuators 40 to retract the holder and the blade. The roller 50 is retracted at substantially the same time by the actuator 55 and, when both the roller and the holder have been fully retracted, the conveyor belt 22 is again advanced to initiate the next cycle.

From the foregoing, it will be apparent that the present invention brings to the art new and improved method and apparatus for disintegrating defective wallboard 11. By handling the wallboard in stacks and by shearing each stack into short sections, the wallboard may be loaded and shredded in a quick and easy manner, in a comparatively safe and clean environment and without excessive noise.

I claim:

1. Apparatus for disintegrating elongated flat sheets of substantially uninterrupted shreddable material having a transverse width less than their length, said apparatus comprising a conveyor for receiving a stack of said flat sheets and for advancing said stack step-by-step along a generally horizontal path, a vertically movable shear having a shear blade located above and transversely to said path, said shear blade having a transverse width at least long as the transverse width of said sheets and being operable when advanced downwardly to cut off successive entire leading end portions of said stack into substantially rectangular cut-off sections each time the stack dwells between successive steps, and a shredder for receiving the cut-off substantially rectangular sections and for shredding such sections into small chunks and particles.

2. Apparatus as defined in claim 1 further including means located adjacent to and upstream of said shear and located above said conveyor for pressing downwardly on said stack as said shear cuts through said stack.

3. Apparatus as defined in claim 2 in which said pressing means comprise a roller supported to rotate about a generally horizontal axis extending laterally of said path, and a selectively operable actuator for raising and lowering said roller to enable said roller to press downwardly on stacks of various heights at a predetermined pressure.

4. An apparatus as defined in claim 2 including means for sensing the pressure of said roller against said stack, and means for operating said shear in response to said pressure sensing means sensing a predetermined pressure.

5. Apparatus as defined in claim 1 in which said shredder is positioned such that the leading end section of said stack overhangs said shredder prior to shearing of said stack whereby each cut-off section falls into said shredder after such shearing.

6. Apparatus as defined in claim 1 in which said shear includes a pair of laterally spaced and generally vertical columns and a holder supporting said shear blade, means supporting said holder for up and down movement on said columns, said supporting means comprising tracks on said columns and further comprising rollers on said shear and engageable with said tracks, vertically extending toothed racks on said columns, and pinions rotatably supported on said holder and meshing with said racks which in combination with said rollers and tracks guide movement of the shear blade relative to said columns and during cutting of said stack.

7. An apparatus as defined in claim 1 in which said shredder comprises a pair of oppositely driven, laterally spaced, shafts each carrying a plurality of axially spaced shredding knives.

8. Apparatus for disintegrating elongated flat sheets of substantially uninterrupted wall-board having a transverse width less than their length, said apparatus comprising a conveyor for receiving a stack of said elongated flat sheets and for advancing said stack step-by-step along a generally horizontal path, a vertically movable shear having a shear blade located above and transversely to said path, said shear blade having a transverse width at least as long as the transverse width of said sheets and being operable when advanced downwardly to shear off entire successive leading end portions of said stack into substantially rectangular cut-off sections each time said stack dwells between successive steps, a pressure roller supported to rotate about a generally horizontal axis extending laterally of said conveyor, said roller being located adjacent to and upstream of said shear, an actuator for advancing said roller downwardly into pressing relation with the top of said stack prior to shearing of said stack whereby said roller stabilizes the stack during the shearing, and a shredder for shredding each substantially rectangular cut-off section of said stack into small chunks and particles, said shredder being located such that the leading end section of said stack overhangs said shredder prior to shearing of said stack whereby each cut-off section falls into said shredder after such shearing.

9. Apparatus as defined in claim 8 in which said shear includes a pair of laterally spaced and generally vertical columns and a holder supporting said shear blade, means supporting said holder for up and down movement on said columns, said supporting means comprising tracks on said columns and further comprising rollers on said shear and engageable with said tracks, vertically extending toothed racks on said columns, and pinions rotatably supported on said holder and meshing with said racks which in combination with said rollers and tracks guide movement of said shear blade relative to said columns during cutting of said stack.

10. A method of disintegrating sheets of elongated flat wallboard comprising a layer of gypsum sandwiched between layers of paper and having a transverse width less than their length, said method comprising the steps of, advancing a stack of said sheets step-by-step along a generally horizontal path toward a shearing station, shearing off a substantially rectangular end section of said stack by vertically passing a shear blade having a transverse dimension at least as wide as said blade for transversely shearing off entire leading end portions of said stack at said shearing station into substantially rectangular cut-off sections when the stack dwells between steps, delivering each cut-off substantially rectangular sections to a shredder, and shredding each cut-off section into small chunks and particles with said shredder.

11. A method as defined in claim 10 further including the step of applying downward pressure to said stack immediately upstream of said shearing station when said stack dwells and before the leading end section of said stack is sheared.

12. A method as defined in claim 11 further including the step of relieving the downward pressure from said stack after the leading end section of the stack is sheared and before the next advance of the stack.

13. A method as defined in claim 11 including passing said shear blade through the stack in response to applying a predetermined downward pressure to said stack.

14. A method as defined in claim 10 in which each cut-off leading end section of said stack is delivered to said shredder by dropping into said shredder immediately after being sheared.

15. A method as defined in claim 10 including advancing said stack of sheets on a conveyor.

16. A method as defined in claim 15 including positioning said stack of sheets on said conveyor with a fork lift truck.

17. A method as defined in claim 10 in which said wallboard in the stack have a thickness in the range of ⅜ inch to 1 inch, and said stack has a height in the range of 6 inches to 48 inches and is advanced along said path in steps of between 6 inches and 24 inches in length.

18. A method as defined in claim 10 in which said stack is advanced along said path in steps of between 6 inches and 24 inches in length, and said shredder shreds said cut-off sections into increments sized between dust and chunks having an area of approximately 2 square inches.

19. A method as defined in claim 10 in which said wallboard comprises a layer of gypsum sandwiched between layers of heavy paper.

20. Apparatus for disintegrating sheets of shreddable material, said apparatus comprising a conveyor for receiving a stack of said sheets and for advancing said stack step-by-step along a generally horizontal path, opposing stationary side walls extending along and projecting upwardly from said conveyor and confining said stack on said conveyor, one of said side walls having a pair of upright slots spaced from one another along a length of said conveyor, said slots opening upwardly out of said one side wall and accommodating the forks of a forklift truck for lowering said stack downwardly onto said conveyor, a vertically movable shear located above said path and operable when advanced downwardly to cut off successive leading end sections of said stack each time the stack dwells between successive steps, and means for shredding each cut-off section into small chunks and particles.

21. Apparatus as defined in claim 20 further including doors for selectively closing said slots.

22. Apparatus for disintegrating sheets of wallboard, said apparatus comprising a conveyor for receiving a stack of said sheets and for advancing said stack step-by-step along a generally horizontal path, opposing stationary side walls extending along and projecting upwardly from said conveyor to confine said stack on said conveyor, one of said side walls having a pair of upright slots spaced from one another along a length of said conveyor, said slots opening upwardly out of said one side wall and accommodating the forks of a forklift truck for lowering said stack downwardly onto said conveyor, a vertically movable shear located above said path and operable when advanced downwardly to shear off successive leading end sections of said stack each time said stack dwells between successive steps, a pressure roller supported to rotate about a generally horizontal axis extending laterally of said conveyor, said roller being located adjacent to and upstream of said shear, means for advancing said roller downwardly into pressing relation with the top of said stack prior to shearing of said stack whereby said roller stabilizes the stack during the shearing, and means for shredding each cut-off section of said stack into small chunks and particles, said shredding means being located such that the leading end section of said stack overhangs said shredding means prior to shearing of said stack whereby each cut-off section falls into said shredding means after such shearing.

23. Apparatus for disintegrating flat elongated sheets of wallboard comprising a layer of gypsum sandwiched between layers of paper and having a transverse width less than their length, said apparatus comprising a conveyor for receiving a stack of said elongated sheets and for advancing said stack step-by-step along a generally horizontal path parallel to the longitudinal axis of said sheets, a vertically movable shear having a shear blade located above and transversely to the longitudinal axis of said sheets and their said path of movement, said shear blade having a transverse width at least as long as the transverse width of said sheets and being operable when advanced downwardly to shear off successive entire leading end portions of said stack into substantially rectangular cut-off sections each time said stack dwells between successive steps, and a shredder comprising a pair of oppositely driven, laterally spaced shafts each having a plurality of axially spaced shredding knives for shredding each cut-off section into small chunks and particles.

24. An apparatus as defined in claim 23 in which said shredder knives are substantially cylindrical in shape.

* * * * *